US005758466A

United States Patent [19]

Tucker

[11] Patent Number: 5,758,466

[45] Date of Patent: Jun. 2, 1998

[54] SNAP-TOGETHER STRUCTURE

[76] Inventor: Jan L. Tucker, Box 783, Winlock, Wash. 98596

[21] Appl. No.: 833,934

[22] Filed: Apr. 10, 1997

[51] Int. Cl.[6] ..... E04B 2/56

[52] U.S. Cl. ..... 52/586.2; 52/36.1; 52/127.1; 52/282.1; 52/282.4; 52/284; 52/300; 52/586.1; 52/DIG. 9

[58] Field of Search ..... 52/36.1, 127.1, 52/282.1, 282.4, 284, 300, 586.1, 586.2, DIG. 9

[56] References Cited

U.S. PATENT DOCUMENTS

| | | | |
|---|---|---|---|
| Re. 32,890 | 3/1989 | DeFouw et al. | 52/239 |
| 3,627,362 | 12/1971 | Brenneman | 52/586.2 |
| 4,953,338 | 9/1990 | Wilson et al. | 52/586.2 |
| 5,007,222 | 4/1991 | Raymond | 52/586.1 |
| 5,070,666 | 12/1991 | Looman | 52/239 |
| 5,211,502 | 5/1993 | Upham-Hill | 52/239 X |
| 5,391,226 | 2/1995 | Frankowski | 52/DIG. 9 X |

*Primary Examiner*—Christopher Kent
*Attorney, Agent, or Firm*—Jack Lo

[57] ABSTRACT

Basic components for a snap-together structure include an elongated wall member with end caps, an elongated connecting member, an elongated corner member, an elongated end plate, and an aperture. Longitudinal locking channels are arranged on opposite sides of the wall member, and on orthogonal sides of the corner member. Each end cap for the wall member includes matching longitudinal locking channels, and a transverse end channel at its outer end extending between the longitudinal locking channels. The end plate includes a base portion and a connecting rib orthogonal thereto for being positioned in the locking channel of the other members. Each locking channel includes a pair of inner locking tabs arranged on opposite inner walls, and the connecting member includes two pairs of outer locking tabs on opposite side walls. The end plate is bolted to a foundation, and a plurality of wall members are stacked horizontally on top thereof. The wall members are connected to each other by connecting members positioned in the locking channels of abutting wall members. The corner member is connected to the ends of the wall members by a connecting member positioned in the locking channel of the corner member and the end channels of the wall members. The aperture is connected to the wall members by positioning the connecting rib in the locking channels. These components are connectable to each other in a variety of other configurations.

11 Claims, 4 Drawing Sheets

SNAP-TOGETHER STRUCTURE

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

This invention relates generally to building construction, specifically to a snap-together structure.

2. Prior Art

The conventional method of constructing a building includes erecting a load-bearing frame of either timber or steel. The members of the frame must be cut to the proper lengths, carefully positioned together, and nailed or bolted to each other. The walls are created separately by covering the frame with panels of steel, wood, or plasterboard, or molding them in concrete.

Insulation must be installed within the walls during construction in yet another separate step. The entire process is very time consuming and expensive.

OBJECTS OF THE INVENTION

Accordingly an object of the present invention is to provide a snap-together structure which can be constructed more quickly and inexpensively.

Another object of the present invention is to provide a snap-together structure that eliminates the need to construct a frame and walls in separate steps.

Another object of the present invention is to provide a snap-together structure that provides built-in conduits for wiring and plumbing.

Yet another object of the present invention is to provide a snap-together structure that provides built-in insulation.

Further objects of the present invention will become apparent from a consideration of the drawings and ensuing description.

BRIEF SUMMARY OF THE INVENTION

A snap-together structure is constructed of several basic elongated components. These include a wall member with a pair of end caps at opposite ends, a corner member, a connecting member, and an end plate. The wall member includes longitudinal locking channels arranged on opposite sides. Each end cap includes matching longitudinal locking channels, and a transverse end channel at its outer end extending between the longitudinal locking channels. The corner member includes longitudinal locking channels arranged on adjacent orthogonal sides. The connecting member is sized to fit into a locking channel, and has a height twice the depth of the channel. The end plate includes a base portion and a connecting rib orthogonal thereto. The connecting rib sized to fit into a locking channel of the other members. Each locking channel includes a pair of inner locking tabs arranged on opposite inner walls, and the connecting member includes two pairs of outer locking tabs on opposite side walls. The end plate is bolted to a foundation, and the wall members are attached on top thereof. The wall members and corner members are connectable to each other in a variety of configurations with the connecting members.

DRAWING REFERENCE NUMERALS

Figure 1:
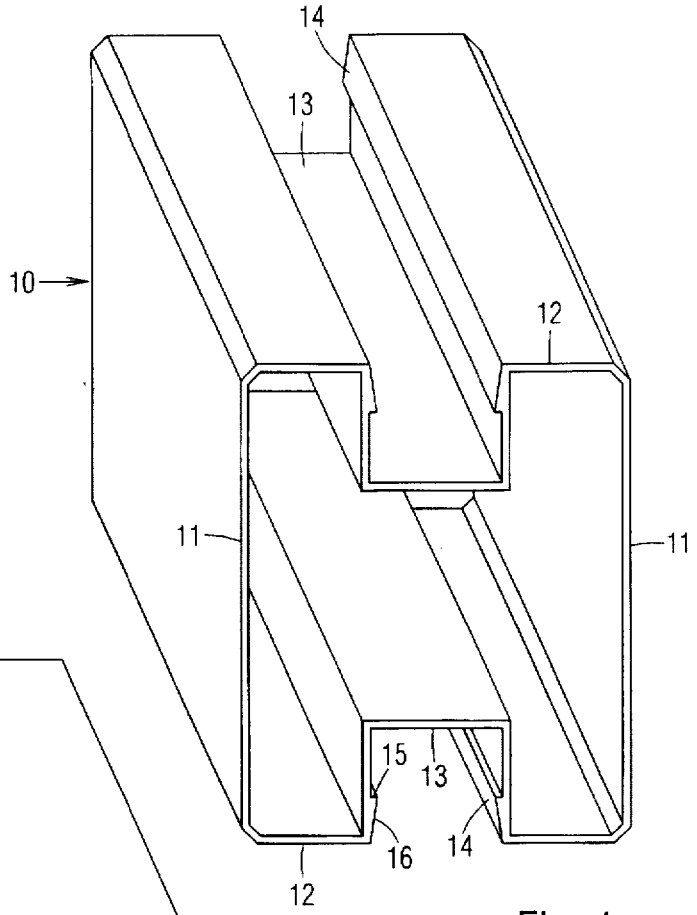
FIG. 1 is an end perspective view of a wall member in accordance with a preferred embodiment of the invention.

10. Wall Member
11. Side Wall
12. Side Wall
13. Locking Channel
14. Locking Tab
15. Locking Surface
16. Tapered Surface
20. Corner Member
21. Side Wall
22. Side Wall
23. Locking Channel
24. Locking Tab
30. End Cap
31. Side Wall
32. Side Wall
33. End Wall
34. Locking Channel
35. End Channel
36. Locking Tab
37. Plug Portion
40. Connecting Member
41. Side Wall
42. Side Wall
43. Locking Tab
50. End Plate
51. Base Portion
52. Connecting Rib
53. Locking Tab
54. Bolt Hole
60. Foundation
61. Bolt
62. Filler Material
70. Window
71. Frame
72. Connecting Rib
73. Locking Tabs

DETAILED DESCRIPTION OF THE INVENTION

FIG. 1

A snap-together structure is constructed of several basic elongated components or members. An elongated wall member 10 is shown in an end perspective view in FIG. 1. Wall member 10 is hollow, and has a generally H-shaped cross section. It includes a pair of opposite side walls 11, and another pair of opposite side walls 12. A pair of locking channels 13 extend longitudinally along side walls 12. A pair of inner locking tabs 14 extend longitudinally along the inner walls of each channel 13. Each locking tab 14 includes a locking surface 15 orthogonal to a wall of channel 13, and a tapering surface 16. Wall member 10 is preferably made of PVC, and can be economically manufactured in any length by extrusion.

FIG. 2

Figure 2:
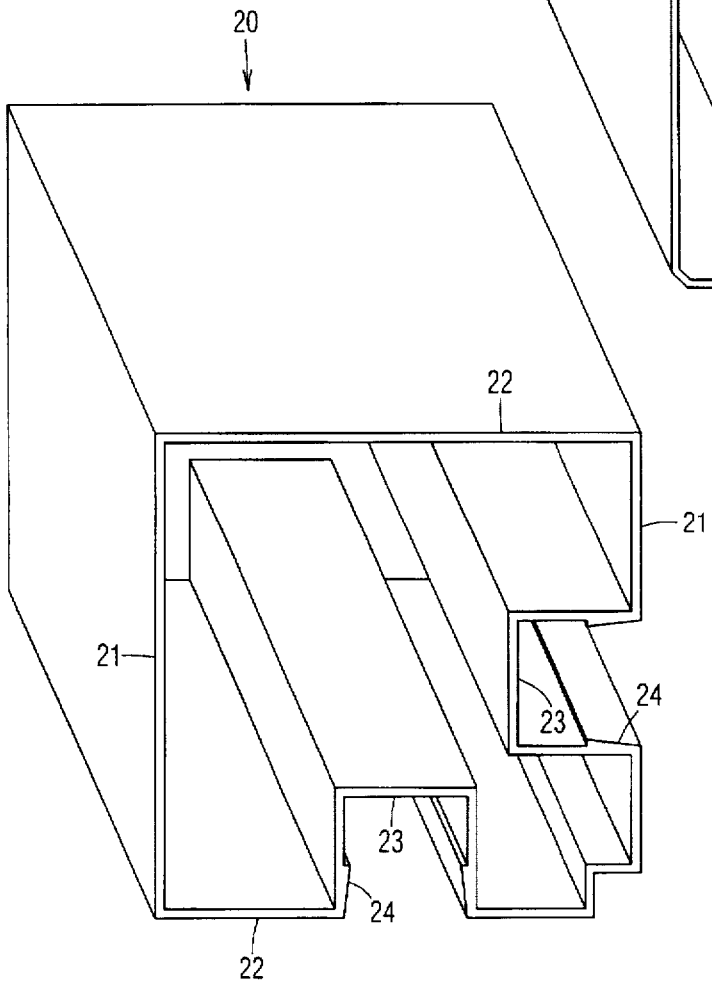
FIG. 2 is an end perspective view of a corner member in accordance with a preferred embodiment of the invention.

An elongated corner member 20 is shown in an end perspective view in FIG. 2. Corner member 20 is hollow, and has a generally square cross section. A pair of locking channels 23 are arranged longitudinally along orthogonal sides 21 and 22. A pair of inner locking tabs 24 are arranged longitudinally along the inner walls of each channel 23. Corner member 20 is preferably made of PVC, and can be economically manufactured in any length by extrusion.

FIG. 3

Figure 3:
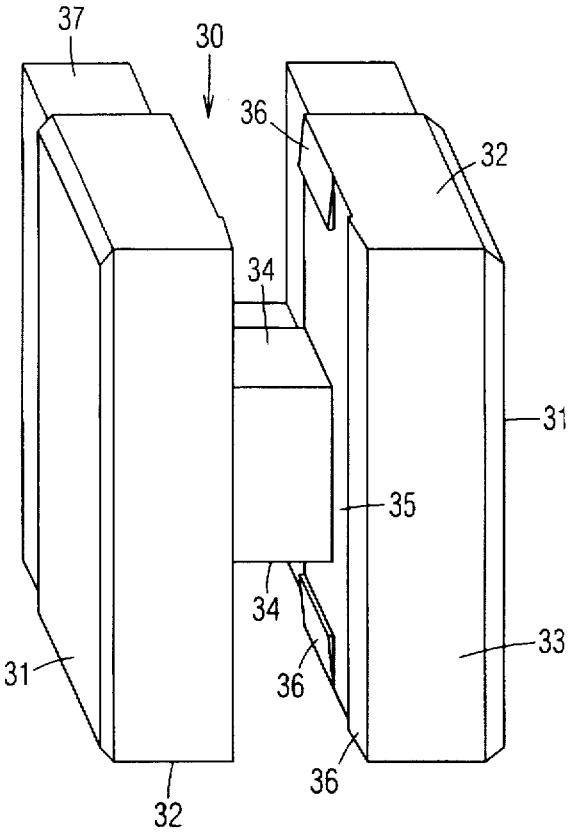
FIG. 3 is an end perspective view of an end cap in accordance with a preferred embodiment of the invention.

An end cap 30 is shown in an end perspective view in FIG. 3. End cap 30 is generally rectangular. It includes a pair of opposite side walls 31, another pair of opposite side walls 32, and an end wall 33. A pair of locking channels 34 extend longitudinally along opposite side walls 32. A transverse end channel 35 is arranged on end wall 33, and extends between channels 34. A pair of inner locking tabs 36 extend along the inner walls of channels 34 and channel 35. End cap 30 has the same cross-sectional dimensions as wall member 10 (FIG. 1). End cap 30 also includes a narrower plug portion 37 opposite end wall 33 for sliding into the end of a wall member 10 (FIG. 1), so that the sides of end cap 30 are flush with the sides of the wall member.

Figure 4:
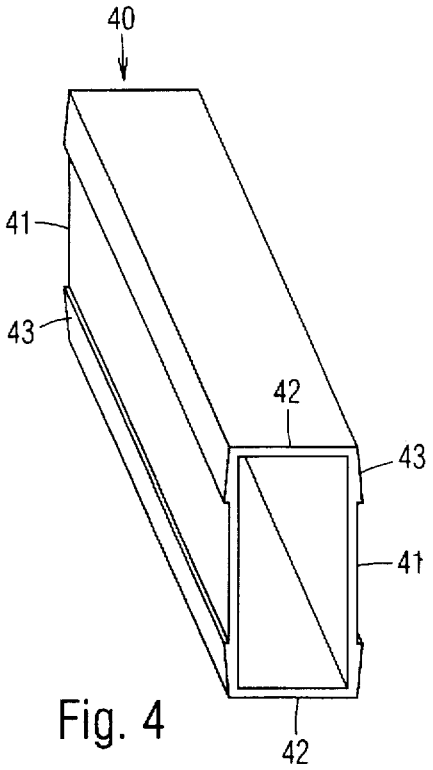
FIG. 4 is an end perspective view of a connecting member in accordance with a preferred embodiment of the invention.

FIG. 4 An elongated connecting member 40 is shown in an end perspective view in FIG. 4. Connecting member 40 is hollow, and has a generally rectangular cross section. It includes a pair of opposite side walls 41, and another pair of opposite side walls 42. Two pairs of outer locking tabs 43 extend longitudinally along opposite side walls 41. Connecting member 40 has a height between walls 42 twice as great as the depth of a locking channel in the wall member (FIG. 1) or corner member (FIG. 2).

FIG. 5

Figure 5:
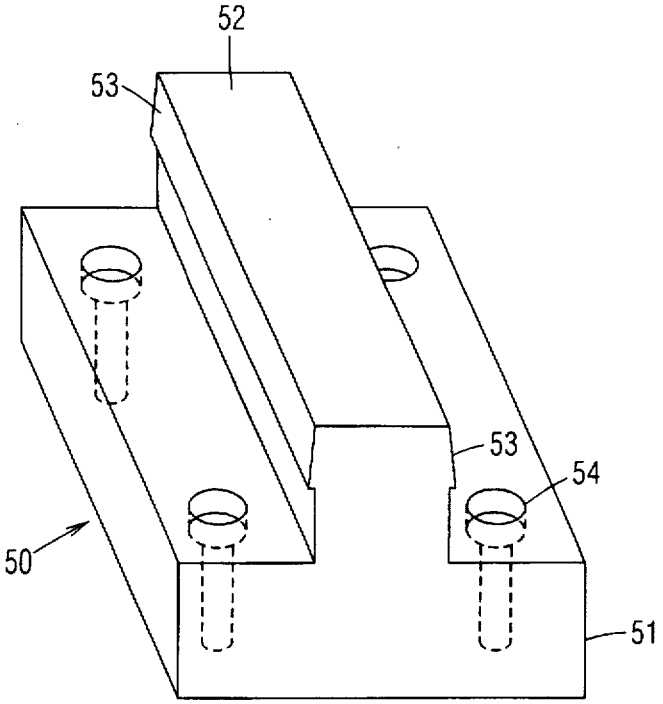
FIG. 5 is an end perspective view of an end plate in accordance with a preferred embodiment of the invention.

An elongated end plate 50 is shown in an end perspective view in FIG. 5. It includes a base portion 51 and a connecting rib 52 protruding orthogonally from a medial point thereof, and extending longitudinally along base portion 51 so as to form a T-shaped cross section. A pair of outer locking tabs 53 are arranged along opposite sides of connecting rib 52. A plurality of countersunk bolt holes 54 are arranged along base portion 51.

FIG. 6

Figures 6, 7:
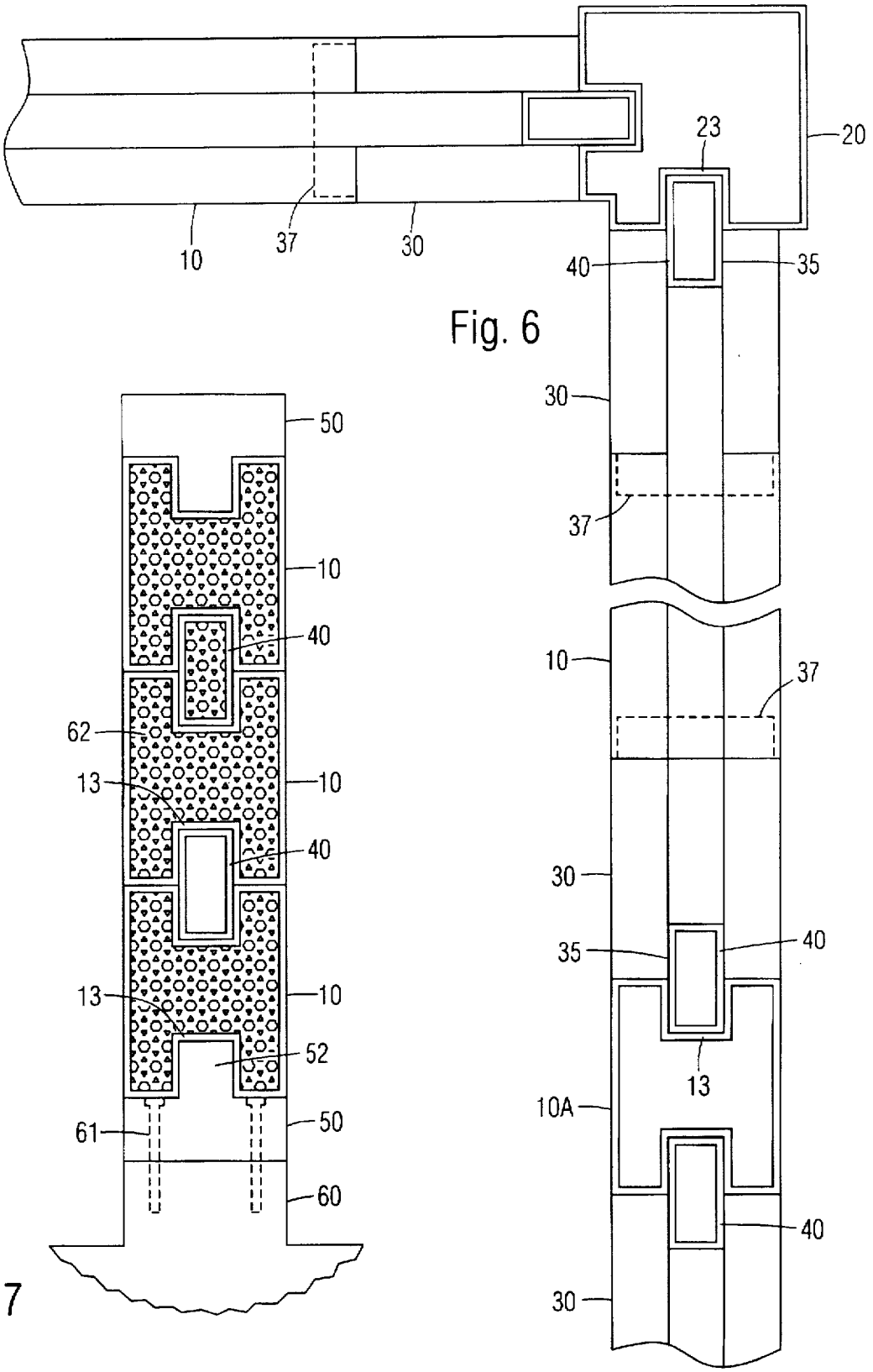
FIG. 6 is a top view of two walls constructed in accordance with the present invention.
FIG. 7 is an end view of a wall constructed in accordance with the present invention.

A pair of orthogonal walls constructed with the snap-together members are shown in a top view in FIG. 6. A pair of end caps 30 are attached to the ends of each wall member 10 by inserting plug portions 37 thereinto. Two or more wall members 10 with end caps 30 are joined to create a longer wall by positioning a wall member 10A vertically therebetween, and connecting each end cap 30 to wall member 10A with a connecting member 40 positioned vertically in end channels 35 in end caps 30, and channels 13 in wall member 10A.

The pair of walls are connected at a right angle by corner member 20. The end cap 30 at the end of each wall is connected to corner member 20 by positioning a connecting member 40 vertically in channel 35 in end cap 30, and channel 23 in corner member 20. The members, which are made of a resilient plastic, are thus easily connected by simply snapping them together. The members form a combined load-bearing structure and wall, which eliminates the need to separately construct a load-bearing frame and non-load-bearing wall surfaces. Therefore, a building can be constructed more quickly and inexpensively. Once connected, the locking tabs (too small to be shown) are securely interlocked, so that the members cannot be separated.

FIG. 7

A wall constructed with the snap-together structure is shown in an end view in FIG. 7. End plate 50 is secured to a foundation 60 by bolts 61. A wall member 10 is attached on top of end plate 50 by positioning connecting rib 52 within a locking channel 13 of the wall member. Additional wall members 10 are stacked on top of each other and connected together with connecting members 40 positioned in adjacent locking channels 13. Another end plate 50 (not shown in FIG. 6) is attached to the topmost wall member 10. A conventional roof (not shown) may be attached to the top end plate 50.

Wall members 10 and connecting members 40 are preferably filled with a filler material 62, such as a rubber and concrete mixture, for strength and insulation, either during manufacturing or at the construction site. The rubber may be recycled automobile tires. Some members, such as one of the connecting members 40 shown, may be left hollow for use as a conduit for wiring and plumbing. Access to the conduit may be provided by drilling holes through the wall. Floors (not shown) for residential buildings may be constructed of conventional panels. Commercial buildings may be constructed on concrete slabs.

FIG. 8

Figure 8:
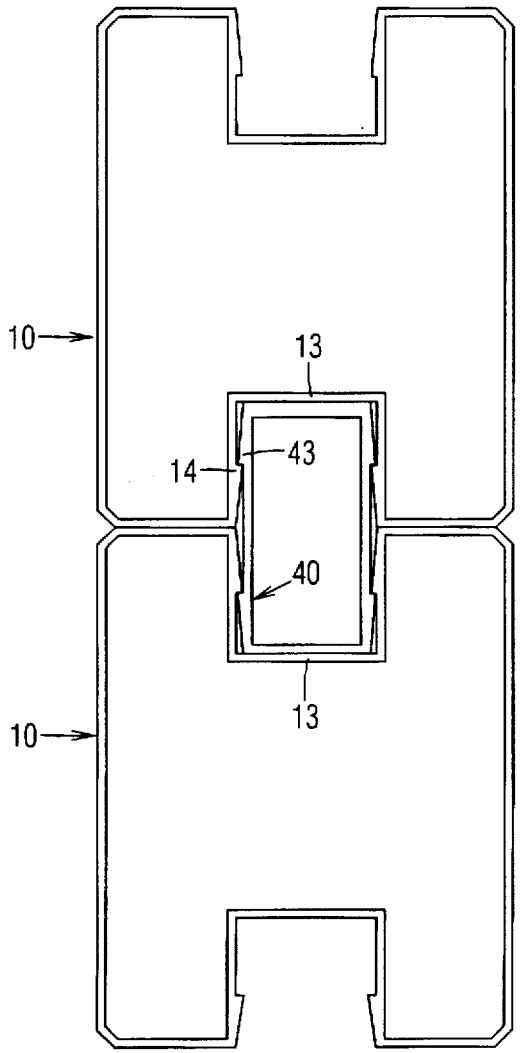
FIG. 8 is an end view of two wall members being connected by the connecting member.

A detailed end view of two wall members 10 connected by a connecting member 40 is shown in FIG. 8. The interlocking of locking tabs 14 and 43 are clearly illustrated. The locking tabs on other members (not shown) interlock with each other likewise.

FIG. 9

Figure 9:
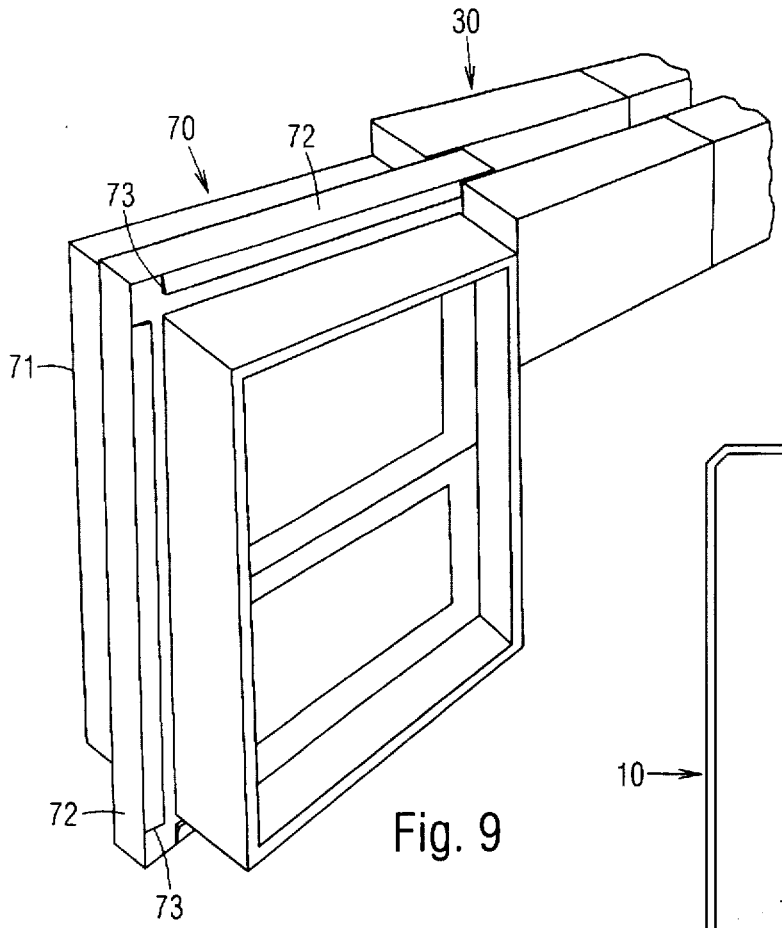
FIG. 9 is a side perspective view of a window in accordance with the present invention.

An aperture defining member or window 70 is shown in a side perspective view in FIG. 9. It includes a rectangular frame 71, and a connecting rib 72 protruding from each side thereof. A pair of outer locking tabs 73 are arranged on opposite sides of each connecting rib 72 for securely connecting to other members, such as the end cap 30 shown.

SUMMARY AND SCOPE

Accordingly, I have provided a snap-together structure which can be constructed more quickly and inexpensively. It eliminates the need to construct a frame and walls in separate steps. It also provides built-in insulation, and built-in conduits for wiring and plumbing.

Although the above descriptions are specific, they should not be considered as limitations on the scope of the invention, but only as examples of the embodiments. Many substitutes and variations are possible within the teachings of the invention. For example, corner member 20 may be shaped for connecting walls at other angles instead of a right angle. In addition to rectangular and square, the members may of other cross sectional shapes. Sides 11 of wall member 10 may be curved for constructing curved or circular walls. Other apertures, such as a door, may be provided with connecting ribs similar to ribs 72 on window 70. Apertures of other shapes may also be provided. The snap-together members may be made of other materials, such as aluminum. The hollow members may be filled with a mixture of other materials, or they may be left hollow. In addition to a vertical wall, the wall members may be used for constructing other parts of a structure, such as a floor or a roof. The members may have more or fewer locking channels. The different members may be attached to each other in a variety of other ways and combinations. Therefore, the scope of the invention should be determined by the appended claims and their legal equivalents, not by the examples given.

I claim:

1. A snap-together structure, comprising:

a plurality of wall members each comprising a first pair of spaced apart opposite side walls connected by a second pair of spaced apart opposite side walls, each of said wall members including an elongated locking channel arranged thereon, said locking channel including a pair of inner locking tabs extending longitudinally along a pair of inner walls thereof, said wall members are positioned against each other so that locking channels on abutting wall members are parallel to and facing each other; and an elongated connecting member positioned longitudinally in said locking channels of said abutting wall members, said connecting member is sized to securely engage said locking channels so as to connect said abutting wall members together, said connecting member including two pairs of outer locking tabs extending longitudinally on opposite sides thereof, said outer locking tabs on said connecting member engaging said inner locking tabs on said locking channels so as to lock said wall members together.

2. The snap-together structure of claim 1, wherein said wall members comprise extruded members, so that said side walls are integrally connected to each other.

3. The snap-together structure of claim 1, further including a filler material received in said wall members.

4. The snap-together structure of claim 3, wherein said filler material is composed of rubber and concrete.

5. A snap-together structure, comprising:

a plurality of elongated wall members each comprising a first pair of spaced apart opposite side walls integrally connected by a second pair of spaced apart opposite side walls, said first pair of said side walls having straight opposite ends extending between said second pair of said side walls, each of said wall members including a pair of elongated locking channels respectively extending longitudinally on said second pair of said side walls, said wall members being positioned laterally against each other, so that locking channels of abutting wall members are positioned parallel to and facing each other;

a plurality of end caps substantially matching said wall members in cross sectional outer dimensions, each of said end caps having a pair of end cap locking channels extending longitudinally thereon, and an end channel on one end extending communicably between said end cap locking channels, each of said end caps including a plug portion extending from an opposite end, said plug portion having smaller cross sectional outer dimensions, said plug portion sliding between said first pair and said second pair of said side walls of one of said wall members, so that said end cap locking channels are aligned with said locking channels on said one of said wall members, end channels of adjacent end caps are in communication and alignment with each other; and a plurality of elongated connecting members positioned longitudinally in said locking channels of said abutting wall members, each of said connecting members is sized to securely engage the locking channels so as to connect said abutting wall members together, further ones of said connecting members also positioned across said end channels of said end caps.

6. The snap-together structure of claim 5, further including a pair of inner locking tabs extending longitudinally along a pair of inner walls of each of said locking channels, and two pairs of outer locking tabs extending longitudinally on opposite sides of each of said connecting members, said outer locking tabs on said connecting members engaging said inner locking tabs on said locking channels so as to lock said wall members together.

7. The snap-together structure of claim 5, further including a filler material received in said wall members.

8. The snap-together structure of claim 7, wherein said filler material is composed of rubber and concrete.

9. The snap-together structure of claim 5, further including a corner member having a pair of elongated locking channels arranged on a pair of generally orthogonal sides thereof, a pair of said wall members being connected to said orthogonal sides of said corner member with a pair of said connecting members positioned in corresponding locking channels.

10. The snap-together structure of claim 5, further including an elongated end plate having a generally T-shaped cross section defined by a connecting rib extending orthogonally from a base portion, said end plate being attached to one of said wall members by positioning said connecting rib in said locking channel of said one of said wall members.

11. The snap-together structure of claim 5, further including an aperture defining member having an elongated connecting rib arranged thereon connecting said aperture defining member to one of said locking channels of one of said wall members.

* * * * *